US008633885B2

(12) United States Patent
Nakayama

(10) Patent No.: US 8,633,885 B2
(45) Date of Patent: Jan. 21, 2014

(54) DISPLAY PANEL DRIVING APPARATUS

(75) Inventor: Akira Nakayama, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 606 days.

(21) Appl. No.: 12/618,813

(22) Filed: Nov. 16, 2009

(65) Prior Publication Data

US 2010/0128026 A1 May 27, 2010

(30) Foreign Application Priority Data

Nov. 21, 2008 (JP) ..... 2008-298075

(51) Int. Cl.
*G09G 3/36* (2006.01)

(52) U.S. Cl.
USPC ..... 345/96; 345/98

(58) Field of Classification Search
None
See application file for complete search history.

(56) References Cited

U.S. PATENT DOCUMENTS 5,973,660 A 10/1999 Hashimoto
7,098,885 B2 * 8/2006 Kumada et al. ..... 345/96
7,304,632 B2 12/2007 Kodama et al.
2004/0189579 A1 9/2004 Shimizu
2008/0158131 A1 * 7/2008 Park et al. ..... 345/98

FOREIGN PATENT DOCUMENTS

| | | |
|---|---|---|
| JP | 10-062744 | 3/1998 |
| JP | 11-030972 | 2/1999 |
| JP | 2001-034233 | 2/2001 |
| JP | 2004-301946 | 10/2004 |

OTHER PUBLICATIONS

Japanese Office Action dated Feb. 26, 2013.
Japanese Office Action dated Sep. 10, 2013.

* cited by examiner

*Primary Examiner* — Joseph Haley
(74) *Attorney, Agent, or Firm* — Volentine & Whitt, PLLC

(57) ABSTRACT

A display panel driving apparatus supplies pixel driving potentials corresponding to pixel data to the source lines of a display panel. The pixels are located at the intersections of the source lines and a set of scanning lines. For each pixel, the driving potentials are alternately positive and negative with respect to a common reference potential supplied to the display panel. While the display driving apparatus is latching the pixel data for the pixels on each scanning line, the output circuits of the display driving apparatus are disconnected from the source lines, allowing the source lines to return to the common reference potential, thereby avoiding unwanted current flows in the output circuits and unwanted distortion of the pixel driving waveforms.

6 Claims, 10 Drawing Sheets

| POL | SWOFF | S1 | S2 |
|---|---|---|---|
| 0 | 0 | 0 | 1 |
| 0 | 1 | 0 | 0 |
| 1 | 0 | 1 | 0 |
| 1 | 1 | 0 | 0 |

DISPLAY PANEL DRIVING APPARATUS

BACKGROUND OF THE INVENTION

1. Field of the Invention

The present invention relates to apparatus for driving a display panel to display an image based on an input image signal.

2. Description of the Related Art

A common type of display panel is an active matrix liquid crystal display panel having m scanning lines extending horizontally and n source lines extending vertically across a two-dimensional liquid crystal display screen, where m and n are integers greater than one. Pixel electrodes are located at the intersections of the source and scanning lines. Also located at each such intersection is a transistor through which the voltage on the source line is applied to the pixel electrode. Each scanning line is connected to the gates of n of these transistors.

This type of liquid crystal display panel has a source driver that generates n voltages corresponding to the brightness levels to be displayed by the n pixels on one scanning line and applies these voltages to the source lines, as described, for example, by Date et al. in Japanese Patent Application Publication No. 2001-034233. To prevent degradation of the liquid crystal material, the source driver periodically switches the polarity of the voltages applied to the liquid crystal. The switching is carried out so that of each two adjacent source lines, one receives a voltage with positive polarity, the other receives a voltage with negative polarity, and these polarities are reversed at regular intervals.

If the polarity reversals are effected with switching elements located between the selectors that select the output potentials and the amplifiers that amplify the selected output potentials and drive the source lines, as taught by Date et al., then each amplifier must be designed for output of potentials of both positive and negative polarity. In addition, immediately following a polarity switchover, there is a momentary large flow of current through the amplifiers to charge or discharge the capacitance of the liquid crystal panel. This unwanted current flow distorts the voltage waveforms applied to the source lines and impairs the quality of the displayed image.

This problem could be addressed by supplying switches between the amplifiers and the source lines to disconnect the amplifiers from the source lines, and further switches to restore the source lines to a common potential, as taught by Kodama et al. in U.S. Pat. No. 7,304,632, but it would then be necessary to provide and control a large number of additional switching elements.

SUMMARY OF THE INVENTION

An object of the present invention is to provide a display panel driving apparatus that can drive a display panel without impairment of the quality of the displayed image and without requiring an excessive number of switching elements.

The invention provides a display panel driving apparatus for receiving an image signal and driving a display panel having a plurality of scanning lines extending horizontally and a plurality of source lines extending vertically across a two-dimensional screen with display cells functioning as pixels located at intersections of the source and scanning lines.

The display panel driving apparatus includes a latch unit that receives a load signal, responds by latching pixel data, and outputs the latched pixel data. The pixel data are obtained from the image signal.

A pixel driving potential generating unit generates first pixel driving potentials higher than a reference potential and second pixel driving potentials lower than a reference potential from the latched pixel data output by the latch unit.

A switching unit switchably interconnects the pixel driving potential generating unit to the source lines.

A control unit supplies the load signal to the latch unit and controls the switching unit. The control unit periodically switches the switching unit between a first state, in which the first pixel driving potentials are supplied to a first group of source lines and the second pixel driving potentials are supplied to a second group of source lines, and a second state, in which the first pixel driving potentials are supplied to the second group of source lines and the second pixel driving potentials are supplied to the first group of source lines.

The control circuit also places the switching unit in a third state, in which the pixel potential generating unit is electrically disconnected from the source lines, for a predetermined interval following supply of the load signal to the latch unit.

During this predetermined interval, the source lines can be brought substantially to the reference potential, so that when the pixel driving potential generating unit is reconnected to the source lines at the end of the predetermined interval, the generated pixel driving potentials are not distorted by large flows of charge or discharge current from the source lines.

This result is obtained without the need to provide or control an excessive number of switching elements, because the switching elements that switch the switching unit between the first and second states can also be used to disconnect the pixel driving potential generating unit from the source lines.

DETAILED DESCRIPTION OF THE INVENTION

Figure 1:
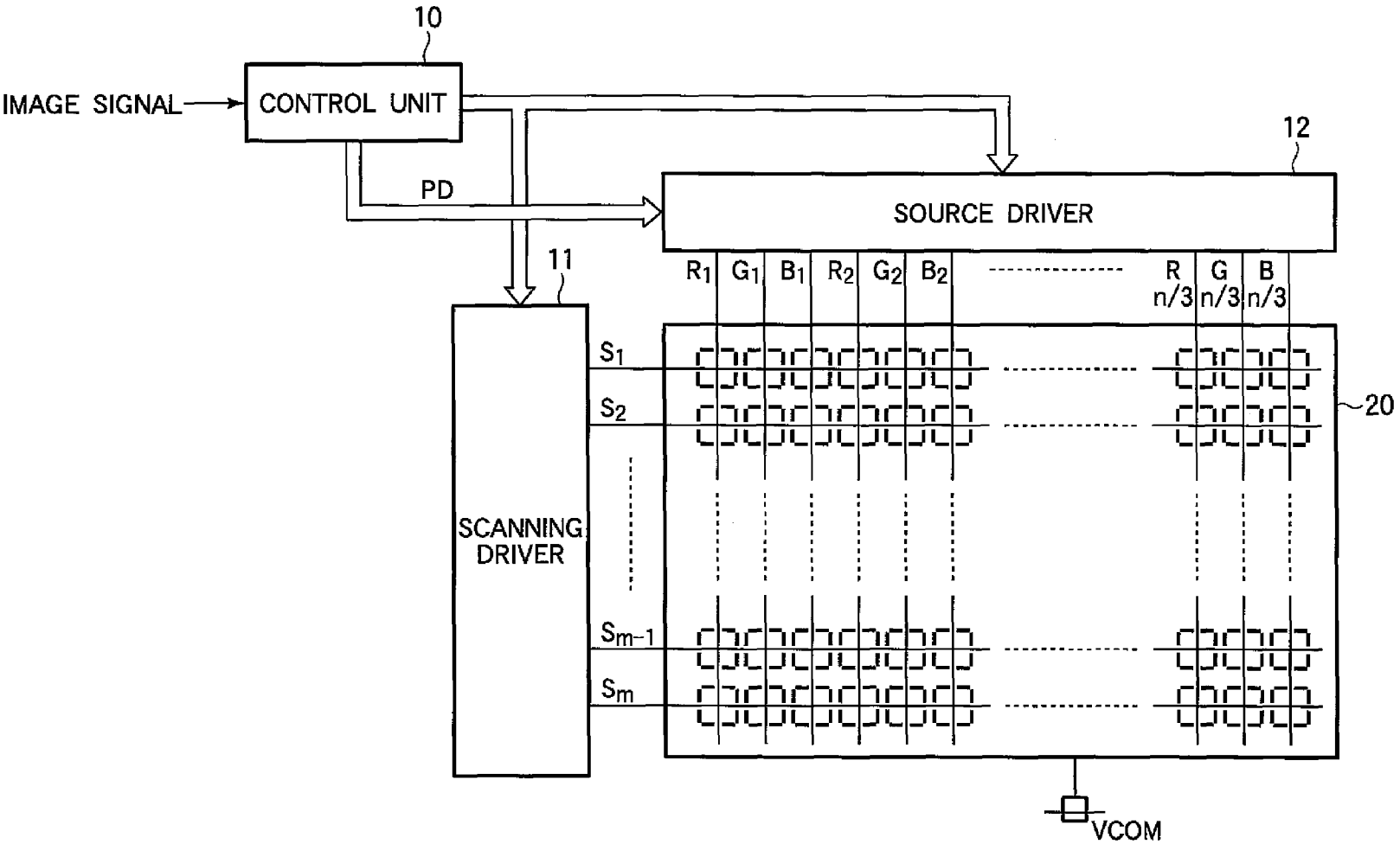
FIG. 1 schematically illustrates a liquid crystal display apparatus including a source driver embodying the present invention.

Embodiments of the invention will now be described with reference to the attached drawings, in which like elements are indicated by like reference characters. The embodiments are source drivers used in a liquid crystal display device.

First Embodiment

Referring to FIG. 1, the liquid crystal display apparatus includes a control unit 10, a scanning driver 11, a source driver 12, and a display panel 20 of the color thin-film transistor (TFT) type, having a liquid crystal layer (not shown).

The display panel 20 includes m scanning lines $S_1$ to $S_m$ extending horizontally across a two-dimensional screen and n source lines extending vertically across the same screen to drive a liquid crystal layer (not shown). The source lines include signal lines $R_1$ to $R_{n/3}$ that drive red pixels, signal lines $G_{n/3}$ to $G_{n/3}$ that drive green pixels, and signal lines $B_1$ to $B_{n/3}$ that drive blue pixels. The pixels, also referred to below as display cells, are the areas indicated by dashed lines at the intersections of the source lines and scanning lines. Each display cell includes a transistor (not shown) that is turned on by a scanning pulse supplied by the scanning driver 11 through one of the scanning lines. When the transistor is in the on state, a pixel driving potential supplied by the source driver 12 is applied through the transistor to one of two electrodes (not shown) on opposite sides of the liquid crystal layer. The other electrode receives a fixed reference potential VCOM. The brightness of the display cell depends on the difference between the pixel driving potential and VCOM.

The input image signal consists of a series of frames, each representing one full-screen image. Each frame consists of a series of horizontal intervals, each horizontal interval including the image data for one horizontal scanning line. From the input image signal, the control unit 10 generates and sends to the scanning driver 11 a frame synchronizing signal indicating the timing at which each frame starts. The control unit 10 also generates and sends to the source driver 12 a load signal indicating the timing at which to latch the pixel data for one horizontal scanning line and apply the corresponding driving voltages to the source lines.

The control unit 10 also sends the source driver 12 a polarity inversion signal POL causing the source driver 12 to invert the polarity of the driving potentials supplied to the source lines at intervals of one or several lines or frames, so that each source line alternately receives driving potentials higher than and lower than VCOM. In frame inversion, for example, the logic level of the polarity inversion signal POL alternates between the '1' level and the '0' level at intervals of k frames, where k is a positive integer. In the following description it will be assumed that k is equal to one.

The control unit 10 also sends the source driver 12 the pixel data PD for each scanning line, six pixels at a time, eight bits per pixel. The pixel data are sent in synchronization with a clock signal CLK1. In the subsequent drawings, the eight-bit data paths that carry the pixel data for odd-numbered red, green, and blue pixels are denoted $P_{R1}$, $P_{G1}$, and $P_{B1}$, respectively; the data paths that carry the pixel data for even-numbered red, green, and blue pixels are denoted $P_{R2}$, $P_{G2}$, and $P_{B2}$, respectively.

Figure 2:
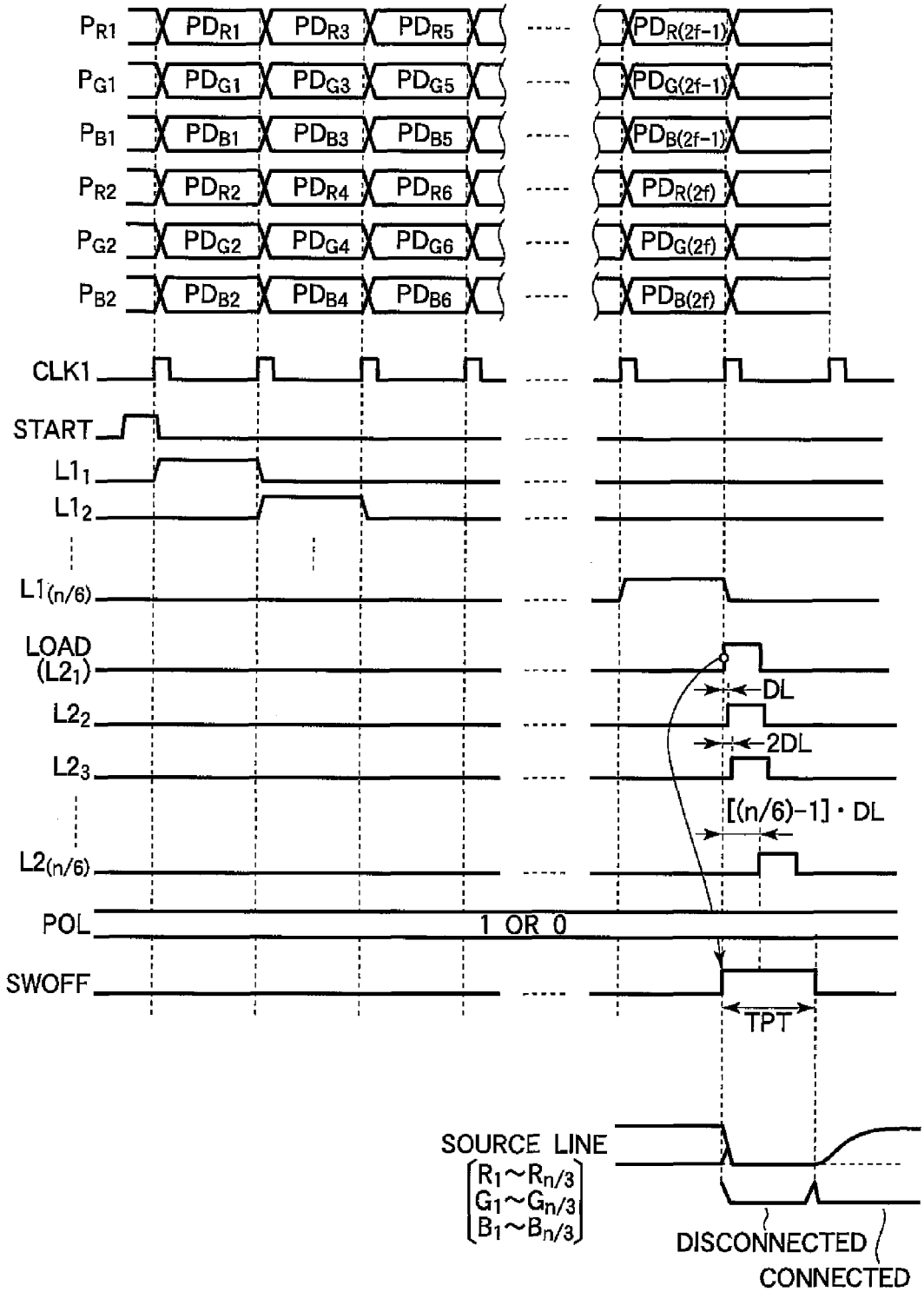
FIG. 2 is a timing diagram illustrating the operation of the source driver in FIG. 1.

Referring to FIG. 2, at the first CLK1 pulse in each horizontal interval, the control unit 10 simultaneously sends the source driver 12 pixel data $PD_{R1}$ for the first red pixel on data path $P_{R1}$, pixel data $PD_{G1}$ for the first green pixel on data path $P_{G1}$, pixel data $PD_{B1}$ for the first blue pixel on data path $P_{B1}$, pixel data $PD_{R2}$ for the second red pixel on data path $P_{R2}$, pixel data $PD_{G2}$ for the second green pixel on data path $P_{G2}$, and pixel data $PD_{B2}$ for the second blue pixel on data path $P_{B2}$.

At the second CLK1 pulse, the control unit 10 simultaneously sends pixel data $PD_{R3}$ for the third red pixel on data path $P_{R1}$, pixel data $PD_{G3}$ for the third green pixel on data path $P_{G1}$, pixel data $PD_{B3}$ for the third blue pixel on data path $P_{B1}$, pixel data $PD_{R4}$ for the fourth red pixel on data path $P_{R2}$, pixel data $PD_{G4}$ for the fourth green pixel on data path $P_{G2}$, and pixel data $PD_{G4}$ for the fourth blue pixel on data path $P_{B2}$.

At the third CLK1 pulse, the control unit 10 simultaneously sends pixel data $PD_{R5}$ for the fifth red pixel on data path $P_{R1}$, pixel data $PD_{G5}$ for the fifth green pixel on data path $P_{G1}$, pixel data $PD_{B5}$ for the fifth blue pixel on data path $P_{B1}$, pixel data $PD_{G6}$ for the sixth red pixel on data path $P_{R2}$, pixel data $PD_{G6}$ for the sixth green pixel on data path $P_{G2}$, and pixel data $PD_{G6}$ for the sixth blue pixel on data path $P_{B2}$.

More generally, at the f-th CLK1 pulse, the control unit 10 simultaneously sends the pixel data $PD_{R(2f-1)}$, $PD_{G(2f-1)}$, and $PD_{B(2f-1)}$ for the (2f−1)-th red, green, and blue pixels and the pixel data $PD_{R(2f)}$, $PD_{G(2f)}$, and $PD_{B(2f)}$ for the (2f)-th red, green, and blue pixels, as shown.

In response to the frame synchronizing signal received from the control unit 10, the scanning driver 11 generates a succession of scanning pulses having a predetermined peak voltage and outputs successive scanning pulses on the successive scanning lines $S_1$ to $S_m$.

The source driver 12 latches the pixel data PD received from the control unit 10 on data paths $P_{R1}$, $P_{G1}$, $P_{B1}$, $P_{R2}$, $P_{G2}$, and $P_{B2}$. After latching all the pixel data for one scanning line, the source driver 12 generates driving pulses with peak potentials corresponding to the latched pixel data and outputs them simultaneously on the n source lines $R_1$ to $R_{n/3}$, $G_1$ to $G_{n/3}$, $B_1$ to $B_{n/3}$.

Figure 3:
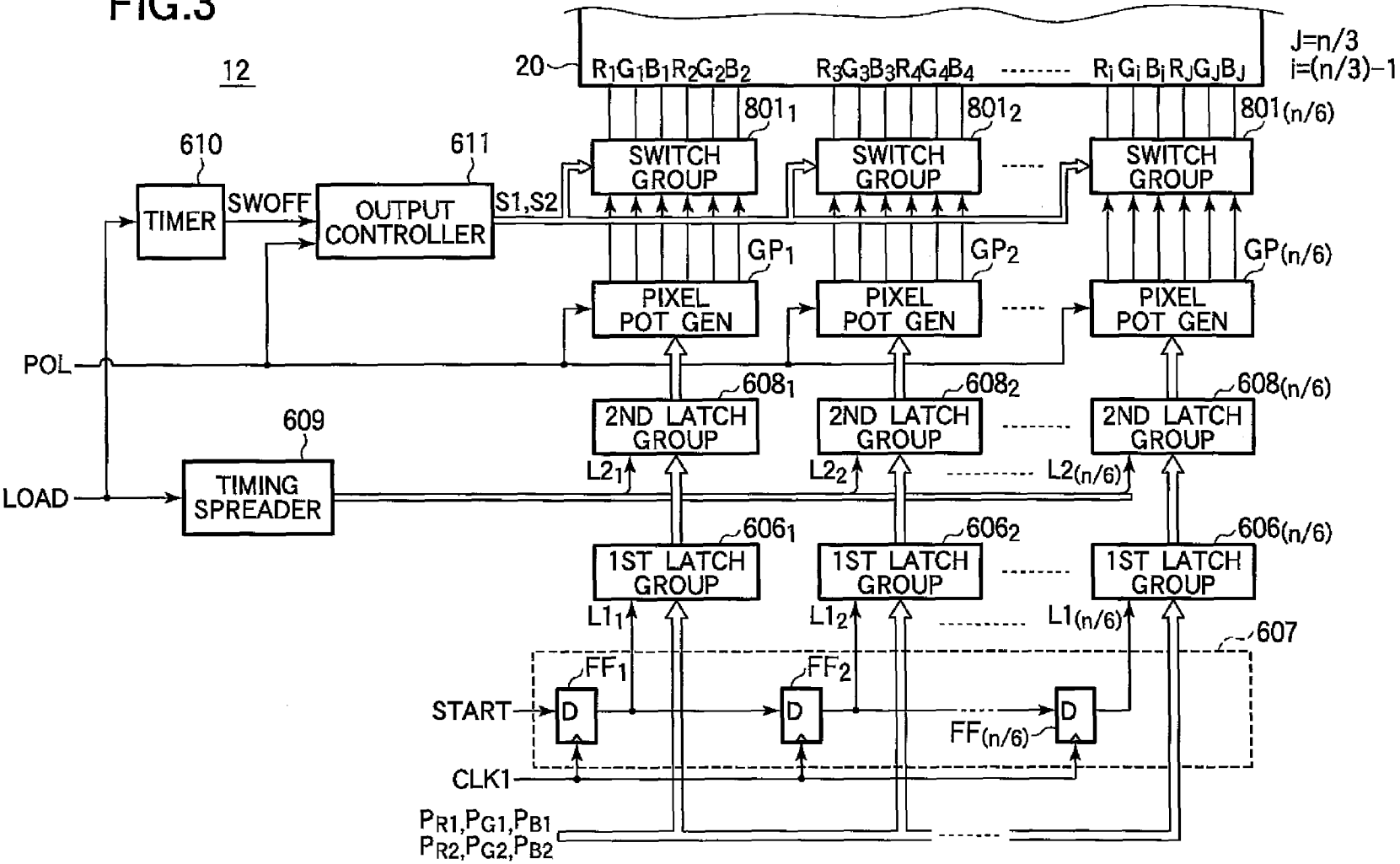
FIG. 3 is a block diagram illustrating the structure of an embodiment of the source driver in FIG. 1.

Referring to FIG. 3, the source driver 12 comprises a first set of latch groups $\mathbf{606}_1$ to $\mathbf{606}_{(n/6)}$, a shift register 607, a second set of latch groups $\mathbf{608}_1$ to $\mathbf{608}_{(n/6)}$, a timing spreader 609, a timer 610, an output controller 611, a set of pixel driving potential generators (PIXEL POT GEN) $GP_1$ to $GP_{(n/6)}$, and a set of switch groups $\mathbf{801}_1$ to $\mathbf{801}_{(n/6)}$.

Figure 4:
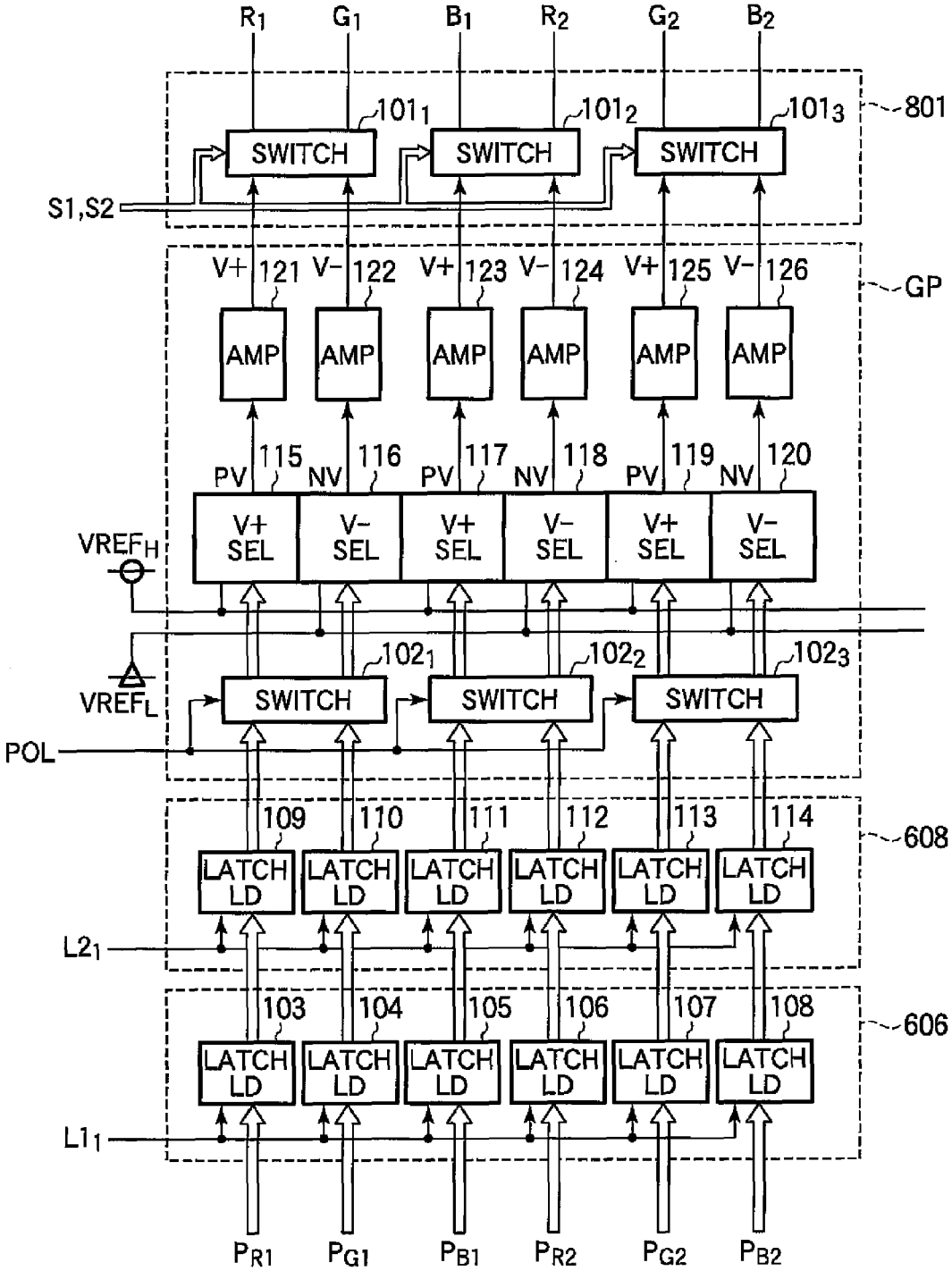
FIG. 4 is a block diagram illustrating the internal structure of representative blocks in FIG. 3.

FIG. 4 shows the first latch group $\mathbf{606}_1$ in the first set, the first latch group $\mathbf{608}_1$ in the second set, the first pixel driving potential generator $GP_1$, and the first switch group $\mathbf{801}_1$. All of the latch groups $\mathbf{606}_1$ to $\mathbf{606}_{(n/6)}$, $\mathbf{608}_1$ to $\mathbf{608}_{(n/6)}$, pixel driving potential generators $GP_1$ to $GP_{(n/6)}$, and switch groups $\mathbf{801}_1$ to $\mathbf{801}_{(n/6)}$ in FIG. 3 have the structure shown in FIG. 4.

The shift register 607 in FIG. 3 comprises a cascaded series of flip-flops $FF_1$ to $FF_{(n/6)}$, all of which receive the clock signal CLK1. The first flip-flop $FF_1$ receives a start pulse from the control unit 10 at the beginning of each horizontal interval. The start pulse is captured in flip-flop $FF_1$ at the first CLK1 pulse in the horizontal interval, and shifted through the successive flip-flops $FF_2$ to $FF_{(n/6)}$ in synchronization with the subsequent CLK1 pulses. The outputs of the flip-flops $FF_1$ to $FF_{(n/6)}$ are also supplied as first load signals $L\mathbf{1}_1$ to $L\mathbf{1}_{(n/6)}$ to the first set of latch groups $\mathbf{606}_1$ to $\mathbf{606}_{(n/6)}$, as shown in FIG. 2.

Each of the latch groups $\mathbf{606}_1$ to $\mathbf{606}_{(n/6)}$ in the first set comprises six eight-bit latches 103 to 108 that latch the data received on data paths $P_{R1}$, $P_{G1}$, $P_{B1}$, $P_{R2}$, $P_{G2}$, $P_{B2}$, respectively, as shown in FIG. 4.

At the first CLK1 pulse in the horizontal interval, flip-flop $FF_1$ in FIG. 3 latches the start pulse and asserts first load signal $L\mathbf{1}_1$, causing the latches 103 to 108 in latch group $\mathbf{606}_1$ to latch pixel data $PD_{R1}$, $PD_{G1}$, $PD_{B1}$, $PD_{R2}$, $PD_{G2}$, $PD_{B2}$.

At the second CLK1 pulse in the horizontal interval, the start pulse is shifted into flip-flop $FF_2$, first load signal $L\mathbf{1}_1$ is inactivated, first load signal $L\mathbf{1}_2$ is activated, and the latches 103 to 108 in latch group $\mathbf{606}_2$ latch pixel data $PD_{R3}$, $PD_{G3}$, $PD_{B3}$, $PD_{R4}$, $PD_{G4}$, $PD_{B4}$.

At the third CLK1 pulse in the horizontal interval, the start pulse is shifted into flip-flop $FF_3$, first load signal $L\mathbf{1}_2$ is inactivated, first load signal $L\mathbf{1}_3$ is activated, and the latches 103 to 108 in latch group $\mathbf{606}_3$ latch pixel data $PD_{R5}$, $PD_{G5}$, $PD_{B5}$, $PD_{R6}$, $PD_{G6}$, $PD_{B6}$.

This operation continues until the latches 103 to 108 in latch group $\mathbf{606}_{(n/6)}$ have latched pixel data $PD_{R(n/6)-1}$, $PD_{G(n/6)-1}$, $PD_{B(n/6)-1}$, $PD_{R(n/6)}$, $PD_{G(n/6)}$, $PD_{B(n/6)}$. On the next CLK1 pulse, the control unit 10 supplies a load signal to the timing spreader 609, which responds by producing a series of second load pulses $L2_1$ to $L2_{(n/6)}$ as shown in FIG. 2. Second load pulse $L2_1$ is coincident with the load signal (LOAD in FIG. 2) supplied by the control unit 10, and is supplied to latch group $608_1$ as shown in FIG. 3. Successive second load pulses $L2_2$ to $L2_{(n/6)}$ are output from the timing spreader 609 with successive delays to latch groups $608_2$ to $608_{(n/6)}$.

Figure 5:
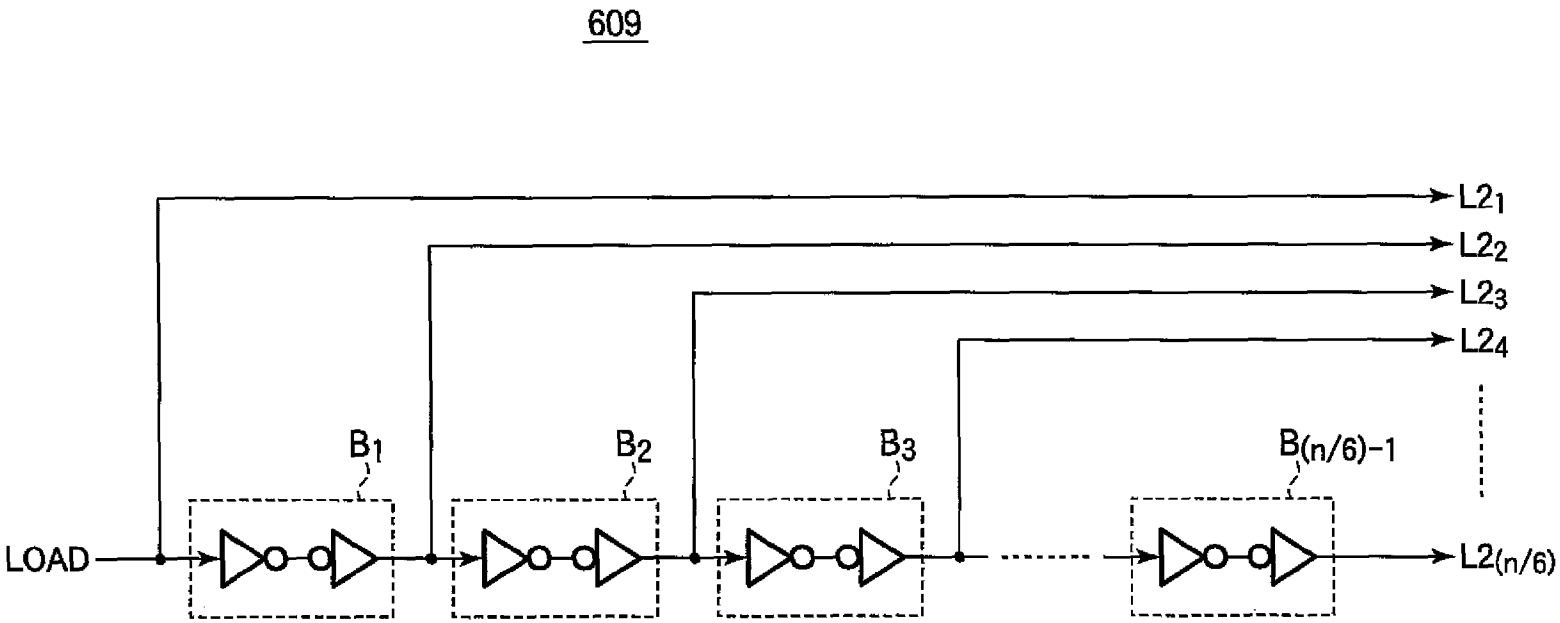
FIG. 5 is a circuit diagram illustrating the internal structure of the timing spreader in FIG. 3.

The timing spreader 609 comprises, for example, a series of buffers $B_1$ to $B_{(n/6)-1}$ as shown in FIG. 5. Buffer $B_1$ receives the load signal, which is also second load signal $L2_1$, and outputs it with a delay DL to buffer $B_2$. The output of buffer B1 is also second load signal $L2_2$. Buffer $B_2$ outputs the load signal with a further delay of DL (a cumulative delay of 2·DL from $L2_1$) to buffer $B_3$. The output of buffer $B_2$ is also second load signal $L2_3$. The load signal continues to propagate through the series of buffers, finally being output by buffer $B_{(n/6)-1}$ with a cumulative delay of ((n/6)−1)·DL from $L2_1$ as second load signal $L2_{(n/6)}$.

Each of the latch groups $608_1$ to $608_{(n/6)}$ in the second set comprises six eight-bit latches 109 to 114 that latch the pixel data output by the corresponding latches 103 to 108 in the first set of latch groups in synchronization with the corresponding second load signal, as shown in FIG. 4, and output the latched pixel data to the corresponding pixel driving potential generator.

For example, the latches 109 to 114 in latch group $608_1$ latch the pixel data $PD_{R1}$, $PD_{G1}$, $PD_{B1}$, $PD_{R2}$, $PD_{G2}$, $PD_{B2}$ supplied by the latches 103 to 108 in latch group $606_1$ in synchronization with second load signal $L2_1$, and output these pixel data to pixel driving potential generator $GP_1$.

Similarly, the latches 109 to 114 in latch group $608_2$ latch the pixel data $PD_{R3}$, $PD_{G3}$, $PD_{B3}$, $PD_{R4}$, $PD_{G4}$, $PD_{B4}$ supplied by the latches 103 to 108 in latch group $606_2$ in synchronization with second load signal $L2_2$, and output these pixel data to pixel driving potential generator $GP_2$ with a delay of DL from second load signal $L2_1$.

The latches 109 to 114 in latch group $608_3$ latch the pixel data $PD_{R5}$, $PD_{G5}$, $PD_{B5}$, $PD_{R6}$, $PD_{G6}$, $PD_{B6}$ supplied by the latches 103 to 108 in latch group $606_3$ in synchronization with second load signal $L2_3$, and output these pixel data to pixel driving potential generator $GP_3$ with a delay of 2·DL from second load signal $L2_1$.

Further pixel data are similarly latched by latch groups $608_4$ to $608_{(n/6)}$ in synchronization with second load signals $L2_4$ to $L2_{(n/6)}$. At the end of this operation all the pixel data for one horizontal scanning line are held in the second set of latch groups and are being output to the pixel driving potential generators $GP_1$ to $GP_{(n/6)}$. The successive delays of DL in the operation of latch groups $608_1$ to $608_{(n/6)}$ prevent electromagnetic interference (EMI) by preventing the instantaneous surge of current that might occur if all of the pixel data were to be latched simultaneously and many of the bit values of the pixel data differed from the previously latched values.

As shown in FIG. 4, each pixel driving potential generator comprises three switches $102_1$ to $102_3$, three positive potential selectors (V+ SEL) 115, 117, 119, three negative potential selectors (V− SEL) 116, 118, 120, and six voltage follower amplifiers 121 to 126.

Switches $102_1$ to $102_3$ are controlled by the polarity inversion signal POL received from the control unit 10. When the polarity inversion signal POL is at the '1' logic level, switches $102_1$, $102_2$, $102_3$ route the pixel data from latches 109, 111, 113 to positive potential selectors 115, 117, 119, respectively, and the pixel data from latches 110, 112, 114 to negative potential selectors 116, 118, 120, respectively. When the polarity inversion signal POL is at the '0' logic level, switches $102_1$, $102_2$, $102_3$ route the pixel data from latches 109, 111, 113 to negative potential selectors 116, 118, 120, respectively, and the pixel data from latches 110, 112, 114 to positive potential selectors 115, 117, 119, respectively.

The positive potential selectors 115, 117, 119 select potentials PV in a range from the fixed reference potential VCOM to a high reference potential VREFH higher than VCOM according to the pixel data received via switches $102_1$, $102_2$, $102_3$, and output the selected potentials PV to respective amplifiers 121, 123, 125. The negative potential selectors 116, 118, 120 select potentials NV in a range from the fixed reference potential VCOM to a low reference potential VREFL lower than VCOM according to the pixel data received via switches $102_1$, $102_2$, $102_3$, and output the selected potentials NV to respective amplifiers 122, 124, 126.

Amplifiers 121, 123, 125 output positive pixel driving potentials V+ equal to the potentials PV received from positive potential selectors 115, 117, 119, respectively. Amplifiers 122, 124, 126 output negative pixel driving potentials V− equal to the potentials NV received from positive potential selectors 116, 118, 120, respectively. Positive and negative are with respect to the reference potential VCOM.

Each of the switch groups $801_1$ to $801_{(n/6)}$ in FIG. 3 comprises three switches $101_1$, $101_2$, $101_3$ as shown in FIG. 4. In the first switch group $801_1$, switch $101_1$ routes the positive and negative pixel driving potentials V+ and V− output by amplifiers 121 and 122 to source lines $R_1$ and $G_1$, *switch* 1012 routes the positive and negative pixel driving potentials V+ and V− output by amplifiers 123 and 124 to source lines $B_1$ and $R_2$, and switch $101_3$ routes the positive and negative pixel driving potentials V+ and V− output by amplifiers 125 and 126 to source lines $G_2$ and $B_2$. These switches $101_1$, $101_2$, $101_3$ are controlled in tandem with switches $102_1$, $102_2$, $102_3$ so that source line $R_1$ receives the potential selected by the pixel data held in latch 109, source line $G_1$ receives the potential selected by the pixel data held in latch 110, source line $B_1$ receives the potential selected by the pixel data held in latch 111, source line $R_2$ receives the potential selected by the pixel data held in latch 112, source line $G_2$ receives the potential selected by the pixel data held in latch 113, and source line $B_2$ receives the potential selected by the pixel data held in latch 114.

The timer 610 in FIG. 3 receives the load signal from the control unit 10 and generates an output switching signal SWOFF. The output switching signal SWOFF rises to the '1' logic level together with the load signal, remains at the '1' level for a predetermined period TPT, and then falls to the '0' level, as shown in FIG. 2.

The output controller 611 in FIG. 3 receives the output switching signal SWOFF from the timer 610 and the polarity inversion signal POL from the control unit 10 and generates two switching signals S1, S2 that control the switches $101_1$, $101_2$, $101_3$ in the switch groups $801_1$ to $801_{(n/6)}$.

Figures 6A, 6B:
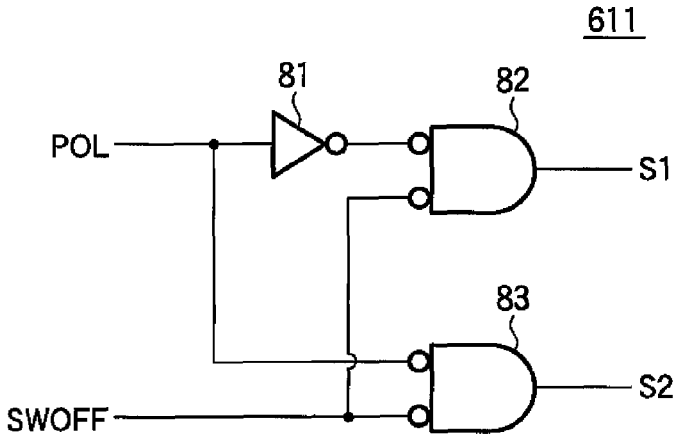
FIG. 6A is a circuit diagram illustrating the internal structure of the output controller in FIG. 3.
FIG. 6B is a truth table illustrating the operation of the output controller.

Referring to FIG. 6A, the output controller 611 comprises an inverter 81 and a pair of NOR gates 82, 83. The inverter 81 inverts the logic level of the polarity inversion signal POL and supplies the inverted signal to NOR gate 82. NOR gate 82 also receives the output switching signal SWOFF and outputs switching signal S1. NOR gate 83 receives the polarity inversion signal POL and the output switching signal SWOFF and outputs switching signal S2. As shown by the truth table in FIG. 6B, both switching signals S1 and S2 are at logic level '0' for the interval of length TPT during which the output switching signal SWOFF is at logic level '1'. At other times, when the output switching signal SWOFF is at logic level '0', switching signal S1 is at logic level '1' if the polarity inversion signal POL is at logic level '1', and switching signal S2 is at logic level '1' if the polarity inversion signal POL is at logic level '0'.

Figure 7:
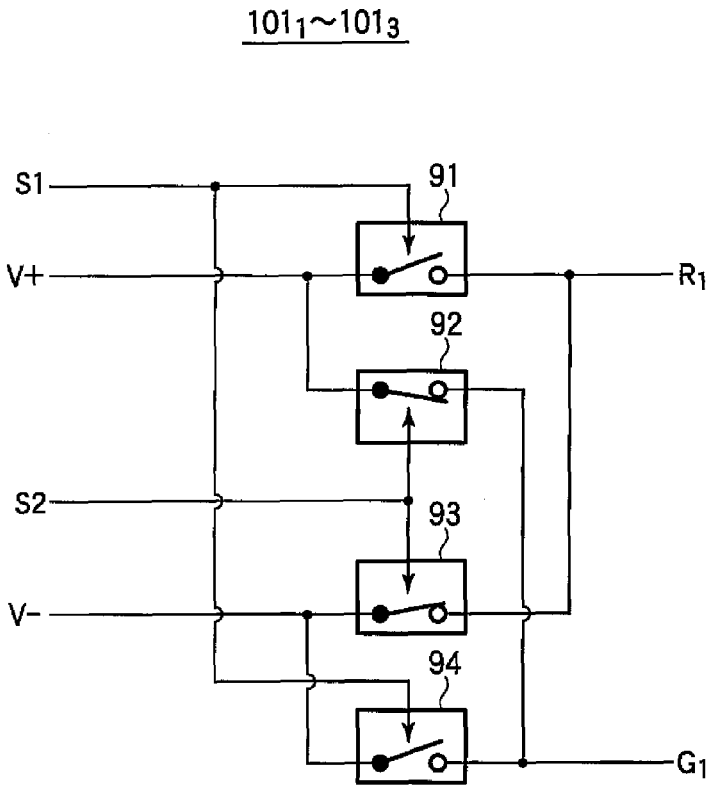
FIG. 7 is a circuit diagram showing the internal structure of the switches at the top of FIG. 4.

Each of the switches $101_1$, $101_2$, $101_3$ in the switch groups $801_1$ to $801_{(n/6)}$ has the structure shown in FIG. 7, comprising switching elements 91, 92, 93, 94. Switching elements 91 and 94 are closed (on) when switching signal S1 is at logic level '1' and open (off) when switching signal S1 is at logic level '0'. Switching elements 92 and 93 are closed (on) when switching signal S2 is at logic level '1' and open (off) when switching signal S2 is at logic level '0'.

In switch $101_1$ in FIG. 4, for example, when switching signal S2 is at logic level '1', source line $R_1$ receives the pixel driving potential output V− output from amplifier 122 via switching element 93 and source line $G_1$ receives the pixel driving potential output V+ output from amplifier 121 via switching element 92, as shown. When switching signal S1 is at logic level '1', source line $R_1$ receives the pixel driving potential output V+ output from amplifier 121 via switching element 91 and source line $G_1$ receives the pixel driving potential output V− output from amplifier 122 via switching element 94. Other pairs of mutually adjacent source lines, e.g., $B_1$ and $R_2$, are switched similarly.

Since switching signals S1 and S2 go to logic level '1' alternately, the voltages applied across the liquid crystal in each display cell in the display panel 20, as seen from the electrode the receives the fixed reference potential VCOM, are alternately positive, when a pixel driving potential V+ higher than VCOM is applied, and negative, when a pixel driving potential V− lower than VCOM is applied.

During the interval of length TPT when the output switching signal SWOFF is at logic level '1' and both switching signals S1 and S2 are at logic level '0', all four switching elements 91, 92, 93, 94 are open and all the source lines in the display panel 20 are disconnected from the source driver 12.

As shown in FIG. 2, the interval TPT set by the timer 610 is longer than the duration from the rise of the first second load signal $L2_1$ to the fall of the last second load signal $L2_{(n/6)}$. The source lines $R_1$-$R_{n/3}$, $G_1$-$G_{n/3}$, $B_1$-$B_{n/3}$ are accordingly disconnected from the pixel driving potential generators $GP_1$ to $GP_{(n/6)}$ throughout the interval during which the pixel data are being latched in the second set of latch groups $608_1$ to $608_{(n/6)}$. During this interval, the amplifiers 121 to 126 in the pixel driving potential generators $GP_1$ to $GP_{(n/6)}$ have time to adjust their output potential levels to the new pixel data latched in the second set of latch groups $608_1$ to $608_{(n/6)}$, and as shown at the bottom of FIG. 2, the potentials on the source lines $R_1$-$R_{n/3}$, $G_1$-$G_{n/3}$, $B_1$-$B_{n/3}$ return substantially to the common reference level. This return to the common reference level may be effected by temporarily interconnecting the sources lines, temporarily interconnecting mutually adjacent pairs of source lines, or temporarily connecting the source lines directly to the reference potential, as shown in U.S. Pat. No. 7,304,632.

At the end of this interval, the source lines $R_1$-$R_{n/3}$, $G_1$-$G_{n/3}$, $B_1$-$B_{n/3}$ are simultaneously reconnected to the pixel driving potential generators $GP_1$ to $GP_{(n/6)}$. The potential levels on the source lines connected to amplifiers 121, 123, and 125 rise smoothly toward the positive polarity pixel driving potentials V+ output by these amplifiers. The potential levels on the source lines connected to amplifiers 122, 124, and 126 fall smoothly toward the negative polarity pixel driving potentials V− output by these amplifiers. For simplicity, FIG. 2 shows only the rise toward one of the positive polarity pixel driving potentials V+.

If the source lines $R_1$-$R_{n/3}$, $G_1$-$G_{n/3}$, $B_1$-$B_{n/3}$ were not disconnected from the pixel driving potential generators $GP_1$ to $GP_{(n/6)}$ during the interval of length TPT, then while the amplifiers 121 to 126 in the pixel driving potential generators $GP_1$ to $GP_{(n/6)}$ were accommodating to the new pixel data, they would also have to contend with the existing potentials held in the capacitances of the source lines and display cells in the display panel 20. Because of the polarity switching, an amplifier 121, 123, or 125 designed to output potentials between the fixed reference potential VCOM and the high reference potential VREFH might find itself suddenly connected to a capacitive load at a potential near the low reference potential VREFL. Similarly, an amplifier 122, 124, or 126 designed to output potentials between the fixed reference potential VCOM and the low reference potential VREFL might find itself suddenly connected to a capacitive load at a potential near the high reference potential VREFH.

Such occurrences would disrupt the normal flow of current in the output stages of the amplifiers 121 to 126. For example, a current source could be forced to operate as a current sink or vice versa, and large charge or discharge currents could produce ground bounce or similar effects. As a result, the waveforms of the pixel driving potentials output by the amplifiers 121 to 126 would be distorted, and the quality of the image displayed on the display panel 20 would be adversely affected.

By disconnecting the amplifiers 121 to 126 from the source lines $R_1$-$R_{n/3}$, $G_1$-$G_{n/3}$, $B_1$-$B_{n/3}$ while the source lines return to the common reference potential and the amplifiers slew toward the new pixel driving potentials, the source driver 12 avoids distortion of the driving waveforms and brings the source lines smoothly to the potentials corresponding to the pixel data. The image quality of the display is improved because all pixels can reach the correct new brightness values quickly.

Second Embodiment

Figure 8:
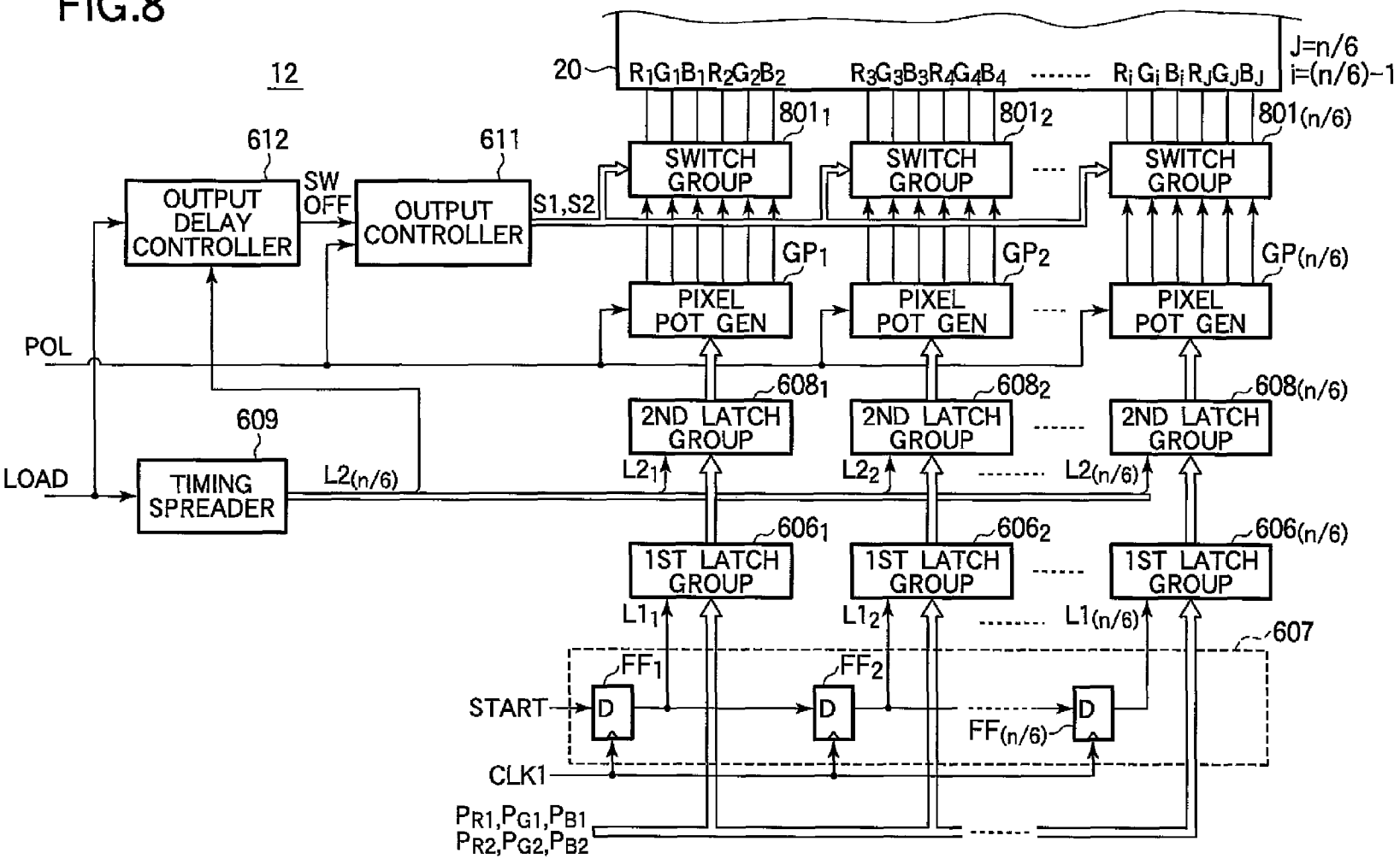
FIG. 8 is a block diagram illustrating the structure of another embodiment of the source driver in FIG. 1.

Referring to FIG. 8, the source driver 12 in the second embodiment differs from the source driver 12 in the first embodiment in having an output delay controller 612 in place of the timer in FIG. 3. The output delay controller 612 generates the output switching signal SWOFF from the load signal (LOAD) received from the control unit 10 and the last second load signal $L2_{(n/6)}$ output by the timing spreader 609. In other respects, the first and second embodiments are the same.

Figure 9:
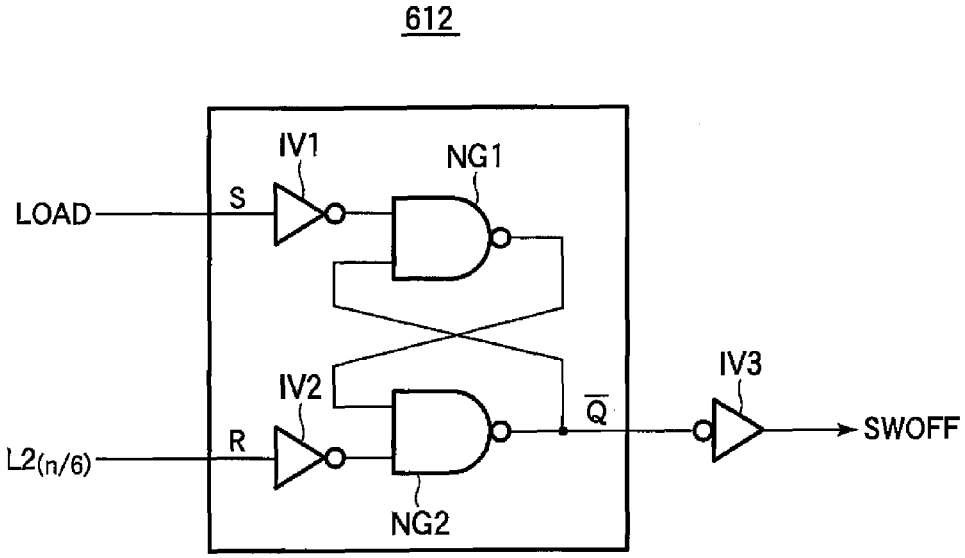
FIG. 9 is a circuit diagram illustrating the internal structure of the output delay controller in FIG. 8.

Referring to FIG. 9, the output delay controller 612 comprises a pair of inverters IV1, IV2 and a pair of NAND gates NG1, NG2 interconnected to form flip-flop circuit, and a third inverter IV3 connected to the output terminal NAND gate NG2, which is the inverted (Q-bar) output of the flip-flop. Inverter IV1 supplies the inverted LOAD signal to NAND gate NG1. Inverter IV2 supplies the inverted last second load signal $L2_{(n/6)}$ to NAND gate NG2. The output switching signal SWOFF is output from inverter IV3. The entire circuit operates as a reset/set (RS) flip-flop with the input terminal of inverter IV1 as the set input S and the input terminal of inverter IV2 as the reset input R.

Figure 10:
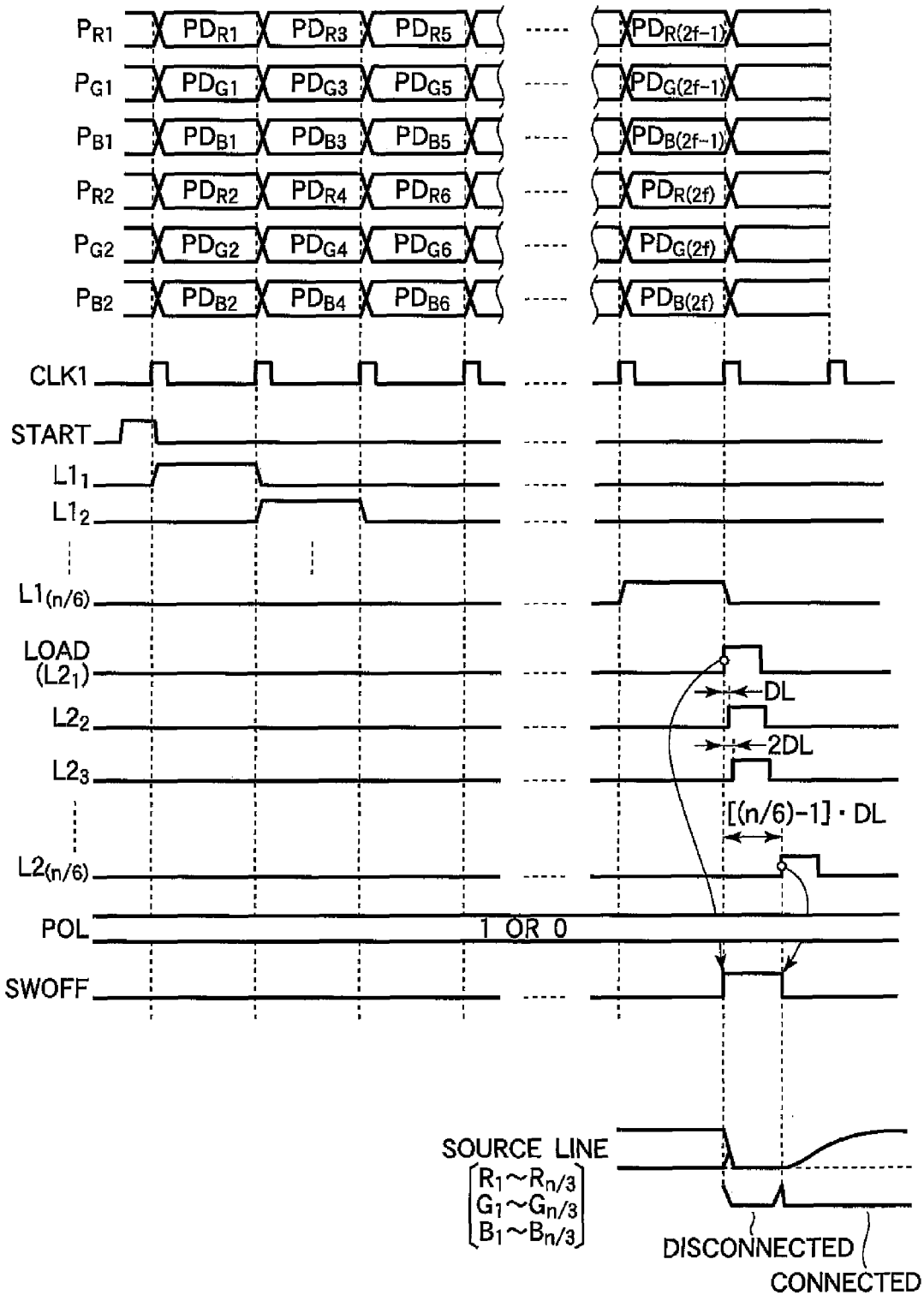
FIG. 10 is a timing diagram illustrating the operation of the source driver in FIG. 8.

As shown in FIG. 10, the output switching signal SWOFF rises with the rise of the LOAD signal and is forcibly reset by the rise of the last second load signal $L2_{(n/6)}$. The output switching signal SWOFF is accordingly at logic level 1 only during the interval from the rise of the LOAD signal to the rise of the last second load signal $L2_{(n/6)}$.

In the second embodiment, the source lines $R_1$-$R_{n/3}$, $G_1$-$G_{n/3}$, $B_1$-$B_{n/3}$ are disconnected from the pixel driving potential generators GP1 to $GP_{(n/6)}$ from the instant when the first latch group $608_1$ in the second set begins to receive the new pixel data until the instant when the last latch group $\mathbf{608}_{(n/6)}$ in the second set begins to receive the new pixel data. During this interval, the source lines return to the common reference potential as in the first embodiment.

When the source lines $R_1$-$R_{n/3}$, $G_1$-$G_{n/3}$, $B_1$-$B_{n/3}$ are reconnected to the pixel driving potential generators $GP_1$ to $GP_{(n/6)}$ at the end of this interval, the pixel driving potential generators $GP_1$ to $GP_{(n/6)}$ are able to bring the source lines from the common reference potential to the potentials corresponding to the new pixel data, without having to contend with potentials of the opposite polarity. This eliminates the disruption of orderly current flow through the output stages of the amplifiers 121 to 126 and the consequent distortion of the driving waveforms. As in the first embodiment, the result is improved image quality.

When the source lines $R_1$-$R_{n/3}$, $G_1$-$G_{n/3}$, $B_1$-$B_{n/3}$ are reconnected to the pixel driving potential generators $GP_1$ to $GP_{(n/6)}$, the amplifiers 121 to 126 in the last pixel driving potential generator $GP_{(n/6)}$ are just starting to slew toward their new pixel driving potentials while the amplifiers 121 to 126 in the first pixel driving potential generator GP1 may already have reached their new potentials. This may lead to slight differences in the times at which different source lines $R_1$-$R_{n/3}$, $G_1$-$G_{n/3}$, $B_1$-$B_{n/3}$ are brought to the new potentials, but the differences are not so large as to impair the improved image quality. The advantage of the second embodiment is that the driving of the source lines starts earlier than in the first embodiment, so the final potentials are reached more quickly.

The number of latches 103 to 108 in the latch groups $\mathbf{606}_1$ to $\mathbf{606}_{(n/6)}$ in the first set of latch groups is not limited to six. In general, for eight-bit pixel data, each latch group may have K eight-bit latches, where K is any integer greater than one. In this case the number of latch groups is n/K, and there are an equal number of flip-flops $FF_1$ to $FF_{(n/K)}$ in the shift register 607 that output respective first load signals $L\mathbf{1}_1$ to $L\mathbf{1}_{(n/K)}$ to respective latch groups $\mathbf{606}_1$ to $\mathbf{606}_{(n/K)}$. The control unit 10 outputs pixel data for K pixels at a time.

The second set of latch groups $\mathbf{608}_1$ to $\mathbf{608}_{(n/6)}$ may be reorganized so that the data output by the first set of latch groups are latched for Q pixels at a time, where Q is any integer greater than one, not necessarily equal to six or K. The timing spreader 609 continues to output second load signals with successive delays of DL, the final cumulative delay being (Q−1)·DL.

Those skilled in the art will recognize that further variations are possible within the scope of the invention, which is defined in the appended claims.

What is claimed is:

1. A display panel driving apparatus for receiving an image signal and driving a display panel having a plurality of scanning lines extending horizontally and a plurality of source lines extending vertically across a two-dimensional screen with display cells functioning as pixels located at intersections of the source and scanning lines, the display panel driving apparatus comprising:

a latch unit for receiving a load signal, latching pixel data responsive to the load signal, and outputting the latched pixel data, the pixel data being obtained from the image signal;

a pixel driving potential generating unit for generating first pixel driving potentials higher than a reference potential and second pixel driving potentials lower than the reference potential from the latched pixel data output by the latch unit;

a switching unit for switching among a first state, a second state and a third state, the switching unit switchably interconnecting the pixel driving potential generating unit to the source lines in the first and second states, the switching unit periodically switching between the first state and the second state, the first pixel driving potentials being supplied to a first group of the source lines and the second pixel driving potentials being supplied to a second group of the source lines in the first state, the first pixel driving potentials being supplied to the second group of the source lines and the second pixel driving potentials being supplied to the first group of the source lines in the second state, the first and second groups of source lines being mutually exclusive, the switching unit electrically disconnecting the source lines from the pixel driving potential generating unit in the third state so that no driving potentials are supplied from the driving potential generating unit to the first and second groups of the source lines; and a control unit for supplying the load signal to the latch unit and controlling the switching unit, the control unit placing the switching unit in the third state for a predetermined interval following supply of the load signal to the latch unit.

2. The display panel driving apparatus of claim 1, wherein the predetermined interval is longer than a length of time needed for the pixel driving potential generating unit to bring the first and second pixel driving potentials to values specified by the pixel data following output of the pixel data from the latch unit.

3. The display panel driving apparatus of claim 1, wherein the predetermined interval ends when the latch unit has received all of the pixel data to be latched responsive to the load signal.

4. The display panel driving apparatus of claim 1, wherein the pixel driving potential generating unit further comprises:

a plurality of potential selectors for selecting the first and second pixel driving potentials; and a plurality of amplifiers for amplifying the selected first and second pixel driving potentials; wherein the switching unit switchably interconnects the plurality of amplifiers to the source lines.

5. The display panel driving apparatus of claim 4, wherein the switching unit further comprises, for each source line in the plurality of the source lines:

one switching element for connecting the source line to one of the amplifiers in the first state and disconnecting the source line from said one of the amplifiers in the second and third states; and another switching element for connecting the source line to another one of the amplifiers in the second state and disconnecting the source line from said another one of the amplifiers in the first and third states.

6. A display panel driving apparatus for receiving an image signal and driving a display panel having a plurality of scanning lines extending horizontally and a plurality of source lines extending vertically across a two-dimensional screen with display cells functioning as pixels located at intersections of the source and scanning lines, the display panel driving apparatus comprising:

a latch unit for receiving a load signal, latching pixel data responsive to the load signal, and outputting the latched pixel data, the pixel data being obtained from the image signal;

a pixel driving potential generating unit for generating first pixel driving potentials higher than a reference potential and second pixel driving potentials lower than the reference potential from the latched pixel data output by the latch unit;

a switching unit for switchably interconnecting the pixel driving potential generating unit to the source lines, the switching unit periodically switching between a first state and a second state, the first pixel driving potentials being supplied to a first group of the source lines and the second pixel driving potentials being supplied to a second group of the source lines in the first state, the first pixel driving potentials being supplied to the second group of the source lines and the second pixel driving potentials being supplied to the first group of the source lines in the second state, the first and second groups of source lines being mutually exclusive; and a control unit for supplying the load signal to the latch unit and controlling the switching unit, the control unit placing the switching unit in a third state for a predetermined interval following supply of the load signal to the latch unit, the pixel driving potential generating unit being electrically disconnected from the source lines in the third state, wherein the pixel driving potential generating unit comprises a plurality of potential selectors for selecting the first and second pixel driving potentials, and a plurality of amplifiers for amplifying the selected first and second pixel driving potentials, wherein the switching unit switchably interconnects the plurality of amplifiers to the source lines, wherein the switching unit comprises, for each source line in the plurality of the source lines one switching element for connecting the source line to one of the amplifiers in the first state and disconnecting the source line from said one of the amplifiers in the second and third states, and another switching element for connecting the source line to another one of the amplifiers in the second state and disconnecting the source line from said another one of the amplifiers in the first and third states, and wherein the plurality of the source lines is divided into mutually exclusive pairs of mutually adjacent source lines, each pair including a first source line and a second source line, the plurality of amplifiers is divided into corresponding mutually exclusive pairs of mutually adjacent amplifiers, each pair including a first amplifier and a second amplifier, and for each one of the mutually exclusive pairs of source lines, the switching unit further comprises a first switching element for connecting the first source line to the corresponding first amplifier in the first state and disconnecting the first source line from the corresponding first amplifier in the second and third states, a second switching element for connecting the second source line to the corresponding first amplifier in the second state and disconnecting the second source line from the corresponding first amplifier in the first and third states, a third switching element for connecting the first source line to the corresponding second amplifier in the second state and disconnecting the first source line from the corresponding second amplifier in the first and third states, and a fourth switching element for connecting the second source line to the corresponding second amplifier in the first state and disconnecting the second source line from the corresponding second amplifier in the second and third states.

* * * * *